US005547917A

United States Patent [19]

Defieuw et al.

[11] Patent Number: 5,547,917

[45] Date of Patent: Aug. 20, 1996

[54] METHOD FOR CLEANING A THERMAL HEAD

[75] Inventors: Geert Defieuw, Kessel-Lo; Marc Van Damme, Heverlee, both of Belgium

[73] Assignee: Agfa-Gevaert, Mortsel, Belgium

[21] Appl. No.: 340,039

[22] Filed: Nov. 14, 1994

[30] Foreign Application Priority Data

Dec. 20, 1993 [EP] European Pat. Off. ..... 93203587

[51] Int. Cl.[6] ..... B41M 5/35; B41M 5/38

[52] U.S. Cl. ..... 503/227; 106/2; 134/2; 134/41; 400/701; 400/702; 570/170

[58] Field of Search ..... 252/89.1, 142, 252/145, DIG. 1; 106/2; 134/2, 41; 400/701, 702; 503/227

[56] References Cited

U.S. PATENT DOCUMENTS 3,681,122 8/1972 Domicone et al. ..... 117/124 F 4,124,523 11/1978 Johnson ..... 252/145

5,240,899 8/1993 Bowman et al. ..... 503/227

*Primary Examiner*—Bruce H. Hess

*Attorney, Agent, or Firm*—Brumbaugh, Graves, Donohue & Raymond

[57] ABSTRACT

Cleaning method for a thermal head used in thermal transfer printers, wherein said cleaning method uses a cleaning solution comprising at least one organic solvent having in pure state a vapour pressure above 25 mbar at 20° C. and a lubricant selected from the group consisting of paraffins, polyolefin waxes, fluor compounds, phosphate compounds, phosphonate compounds, polysiloxanes, fatty acids, fatty acid esters, fatty alcohols, fatty acid amides, fatty acids salts and polyalkyleneoxides.

9 Claims, No Drawings

METHOD FOR CLEANING A THERMAL HEAD

DESCRIPTION

1. Field of the Invention

The present invention relates to a cleaning method used to remove debris from a thermal head in a thermal transfer printing apparatus.

2. Background of the Invention

Thermal printing includes all printing methods using heat to print images or information on a sheet or web such as direct thermal printing and thermal transfer printing. In direct thermal printing, heat generates a chemical or physical reaction in the material to be printed, resulting in an image on said material.

Thermal transfer printing is a recording method in which a dye-donor element with a dye layer containing dyes is brought into contact with a receiver sheet and selectively, in accordance with a pattern information signal, is heated by means of a thermal printing head provided with a plurality of juxtaposed heat-generating resistors, so that dye or dye layer is transferred from the selectively heated regions of the dye-donor element to the receiver sheet and forms a pattern thereon.

In thermal wax transfer, the entire dye layer (dye or pigment with binder) is transferred to the receiver sheet.

In thermal dye transfer, sublimation transfer (also called dye diffusion thermal transfer, D2T2), only the dye is transferred to the receiver sheet. This last process has the possibility to change the amount of dye transferred by the applied heat of an individual resistor.

A dye-donor element for use according to thermal dye sublimation transfer usually comprises a very thin support e.g. a polyester support, one side of which has been covered with a dye layer comprising the printing dyes. Usually, an adhesive or subbing layer is provided between the support and the dye layer.

Owing to the fact that the thin support softens when heated during the printing operation and then sticks to the thermal printing head, thereby causing malfunction of the printing apparatus and reduction in image quality, the back of the support (the side opposite to that carrying the dye layer) is typically provided with a heat-resistant layer to facilitate passage of the dye-donor element under the thermal printing head. An adhesive layer may be provided between the support and the heat-resistant layer.

The heat-resistant layer generally comprises a lubricant and a binder. In the conventional heat-resistant layers the binder is either a cured binder as described in e.g. EP 153 880, EP 194 106, EP 314 348, EP 329 117, JP 60/151 096, JP 60/229 787, JP 60/229 792, JP 60/229 795, JP 62/48 589, JP 62/212 192, JP 62/259 889, JP 01/5884, JP 01/56 587 and JP 02/128 899 or a polymeric thermoplast as described in e.g. EP 267 469, EP 527 520, U.S. Pat. No. 5,234,888, U.S. Pat. No. 5,240,899, EP 227 090, EP 228 065, EP 234 043, U.S. Pat. No. 4,738,950, U.S. Pat. No. 4,829,050, U.S Pat. No. 4,866,028, U.S. Pat. No. 4,753,920, U.S. Pat. No. 4,782,041, EP 389 153 and U.S. Pat. No. 4,916,112.

Although some of the heat-resistant layers mentioned above protect the dye-donor elements from being deformed as a result of the heating process, in a thermal printer, debris is formed on the surface of the thermal head. This debris is formed on and in the neighbourhood of the heat-generating resistors of the thermal head. This debris can be dirt which was already on the dye-donor element before printing, dirt which felt on the back side of the dye-donor element during printing or dirt formed by the thermal degradation of the ingredients of the dye-donor element. This debris causes poor contact between dye-donor element and said receiver sheet and results in a bad image quality (strikes).

In direct thermal printing, the slipping agents are added to the top layer of the recording material (e.g. paper). The same problem as seen in thermal transfer, i.e. formation of debris on the thermal head, is observed in direct thermal printing.

A known method to clean the thermal head is to use a cleaning sheet, which has the same form as a dye-donor element (e.g. JN 60115476, JN 01258988, WO 93021020). This cleaning sheet can have cleaning substances on the side in contact with the thermal head. However, inserting a separate cleaning sheet into a printer takes too much time. Moreover, cleaning is less efficient, since only moderate amounts of cleaning products such as solvents can be used in these cleaning sheets.

It is known to use a wipe containing an organic solvent to clean the thermal head. However, the complete removal of slipping agents from the surface of the thermal head results in poor transfer properties of the dye-donor element relative to the thermal head, especially during the first prints after the cleaning procedure. This problem can be eliminated by using a thermal head cleaning wipe or pencil soaked with a liquid lubricant such a polydimethylsiloxane oil. However, the first print after a cleaning procedure, using a cleaning pencil based on a pure liquid lubricant such as polydimethylsiloxane oil, exhibits image quality defects, such as density variations along the length of the print. This problem arises especially in thermal sublimation printing, where density uniformity is of critical importance. Moreover, liquid lubricants are usually bad solvents for organic compounds such as dyes or polymers used in the dye-donor element. Therefore, it appears to be difficult to remove degradation products of the dye-donor element from the thermal head.

SUMMARY OF THE INVENTION

It is an object of the present invention to provide a thermal head cleaning method, not having the disadvantage mentioned above. Further objects will become apparent from the description hereinafter. According to the present invention, a cleaning method for a thermal head used in thermal printers is provided, wherein a cleaning solution is applied to the thermal head, said cleaning solution comprising at least one organic solvent having in a pure state a vapour pressure above 25 mbar at 20° C. and a lubricant selected from the group consisting of paraffins, polyolefin waxes, fluor compounds, phosphate compounds, phosphonate compounds, polysiloxanes, fatty acids, fatty acid esters, fatty acid amides, fatty acid salts, fatty alcohols and polyalkyleneoxides.

In accordance with the present invention said cleaning solution can be applied to the thermal head by means of a wipe or a pencil soaked or filled with said cleaning solution.

DETAILED DESCRIPTION OF THE INVENTION

The lubricant of the present invention is selected from the group of paraffins, polyolefin waxes, fluor compound, phosphate compounds, phosphonate compounds, polysiloxanes, fatty acids, fatty alcohols, fatty acid esters, fatty acid amides and fatty acid salts and polyalkyleneoxides. Paraffins can be solids, waxes or oils. Oils are preferred.

Examples of polyolefin waxes are polyethylene wax, polypropylene wax, copolymers of ethylene with propylene or other higher olefins, oxidized polyethylene and the like. Fluor compounds useful in the present invention are e.g. Fluorad FC430 and FC431 (manufactured by 3M), Zonyl FSA, Zonyl FSO, Zonyl FSA, Zonyl FSP (DuPont). Phosphate compounds are e.g. mono, di or tri esters of phosphoric acid, optionally in the mono or multivalent salt form. Examples are Gafac RD510, RE610, RP710, RE960, GB520, LO529, RA600 (Rhône Poulenc, GAF), Servoxyl VPAZ100, VPDZ100, VPDZ6/100, VPIZ100, VPNZ9/100, VPTZ200, VPTZ3/100, VPUZ100 (Servo Chemie, Huls). Phosphonate compounds such as mentioned in EP-A-513630 are useful in the present invention.

Polysiloxanes can be oils, elastomers, resins and non-crosslinked solids. Silicon oils may be pure siloxanes such as e.g. polydimethylsiloxane or other polyalkylsiloxanes, may comprise functional groups at one or both sides of the chain end or as side chains. Block copolymers derived from polysiloxanes are especially preferred. Examples are polyether modified polydialkylsiloxanes such as Tegoglide 100, Tegoglide 410, Tegoglide 440 (Goldschmidt) or Byk 320, Byk 306, Byk 310, Byk 322 (Byk Chemie). Examples of functionalized polysiloxanes are Tegomer H SI 2111 (Goldschmidt), KF393 (Shinetsu) and PS413 (Petrarch Systems). Fatty acids are e.g. stearic acid, oleic acid, palmitic acid and the like. Fatty acid esters are e.g. mono, di or tri esters of glycerol or butylstearate. Examples of fatty acids amides are ethyleenbisstearamide, oleamide, stearamide and the like. Polyalkyleneoxides can e.g. be homo- or copolymers of polypropylene oxide and polyethyleneoxide. Polyalkyleneglycol derivatives can be e.g. nonylphenyl terminated polyethyleneoxide such as Antarox CO630 (GAF) and the like.

Among the above lubricants, liquid lubricants are preferred. Especially those soluble in the solvent or solvent mixture used in the cleaning solution are preferred. Polysiloxanes are preferred, especially the polyalkyleneoxide modified polysiloxanes. The use of blockcopolymers of polyethyleneoxide or polypropyleneoxide with polydialkylsiloxanes is especially preferred.

The concentration of the lubricant in the cleaning solution is preferably between 0.1 and 30 weight percent, more preferably below 10 weight percent and most preferred between 0.2 and 5 weight percent. A combination of two or more lubricants can be used in the present invention.

The organic solvent in its pure state of the present invention needs to have a vapour pressure above 25 mbar at 20° C. In this case, evaporation of the solvent is fast enough to restart the printer immediately after cleaning the thermal head. Examples of such solvent are methanol, ethanol, isopropanol, aceton, ethyl methylketone, ethylacetate, cyclohexaan and diethylether. A solvent having a vapour pressure in its pure state at 20° C. of 25 mbar or lower can be added to the cleaning solution, as long as the sum of the weight percentages of the highly volatile solvents, having a vapour pressure in its pure state at 20° C. above 25 mbar is higher than the sum of the weight percentages of solvents having in their pure state a vapour pressure at 20° C. of 25 mbar or less. Solvents with a low volatility can e.g. be water, cyclohexanon, butylacetate, and methyl isobutylketone.

Preferably, the sum of the concentration of those solvents having a vapour pressure at 20° C. of 25 mbar or lower is preferably below 20%, most preferably below 10%.

Tensioactive products can be added to help spreading of the lubricant along the surface of the thermal head.

Thickeners, such as polymers soluble in the solvent mixture used in the cleaning solution, may be added to the cleaning solution used in accordance with the present invention.

The cleaning solution can be dropped onto a conventional, dry cleaning wipe just before the cleaning of the thermal head, or can be provided as a soaked wipe in a closed pouch.

A second and more preferred way of application of the above cleaning solution is a cleaning method whereby said cleaning solution is applied to the thermal head by means of a pen, such as a felt-tip pen or fiber-tip pen. The cleaning solution can be filled inside the pen. The advantage of said pen is that the organic solvents and lubricants aren't in direct contact with the hands of the user and that the pen can be used manyfold. The tip of the pen is preferably flat, or line-shaped in order to follow easily the resistor line during the cleaning procedure. More preferably, the flat type has a flat surface of at least 2 square millimeters at the tip and the length of the line-shaped tip is at least 2 millimeters.

It can be advantageous to add inorganic particles to said cleaning solution, in order to increase the cleaning efficiency of said cleaning solution. Examples are quartz particles such as Min-u-sil 5, amorphous silica such as Syloid 378, dolomite particles such as Microdol Super or Microdol Extra (Norwegian Talc) or talc, such as Nippon Talc K1 (Nippon Talc).

When inorganic particles are added to the cleaning solution, it can be useful to perform a second cleaning step wherein the cleaning solution according to the present invention is repeated and whereby the second cleaning solution comprises no inorganic particles. The second cleaning helps to remove the inorganic cleaning particles from the surface of the thermal head.

The cleaning method of the present invention can be used for thermal heads manufactured by the thick and thin film technology. These thermal heads are used in direct thermal and thermal transfer techniques. Among the thermal transfer techniques, thermal wax transfer and dye diffusion thermal transfer are known. The above cleaning method is especially useful for cleaning a thin film thermal head, used for dye diffusion thermal transfer. It has the advantage that the density uniformity of an image obtained with a dye diffusion thermal transfer printer is excellent when the thermal head of the printer is regularly cleaned with the cleaning method of the present invention.

A second important area of application is the field of direct thermal continuous tone film printer. In these printers, density uniformity is also extremely important. The direct thermal continuous tone film can e.g. be based on a silver salt-reductor system or a leucobase-acid system. The following examples illustrate the invention in more detail without, however, limiting the scope thereof.

EXAMPLES

A thermal head of Kyocera type KGT-219-12MP4-27-SPM was mounted in the dye diffusion thermal transfer printer.

Image receiving sheets were prepared by coating a polyethylene terephthalate film support having a thickness of 175 μm with a dye image-receiving layer from a solution in ethyl methyl ketone of 3.6 g/m$^2$ of poly(vinyl chloride/co-vinyl acetate/co-vinyl alcohol) (Vinylite VAGD supplied by Union Carbide), 0.336 g/m$^2$ of diisocyanate (Desmodur VL supplied by Bayer AG), and 0.2 g/m$^2$ of hydroxy-modified polymdimethylsiloxan (Tegomer H SI 2111 supplied by Goldschmidt).

Dye-donor elements were prepared by coating a 5.7 μm thick polyethyleneterephthalate film on both sides with a subbing layer comprising an aromatic branched copolyester from butanone on one side of the dye-donor element, a dye layer comprising 9% of dye I and 2% of dye II, 0.5% of Tospearl 120 (General Eletric Plastics), and 10% of Luran 388S (BASF) was coated from butanon (10 μm wet thickness). On the side opposite to said dye layer, a heat-resistant layer comprising a binder of the following formula

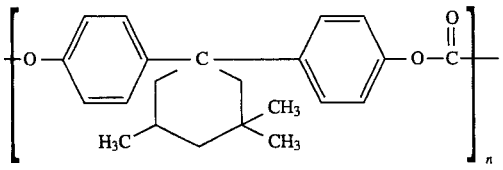

wherein n represent the number of repeating units to obtain a relative viscosity of 0.130 as measured in a 0.5% solution in dichloromethane, a microfine talc and a zinc stearate dispersion with a mean particle diameter of 3 μm was applied from butanon.

Dye I:

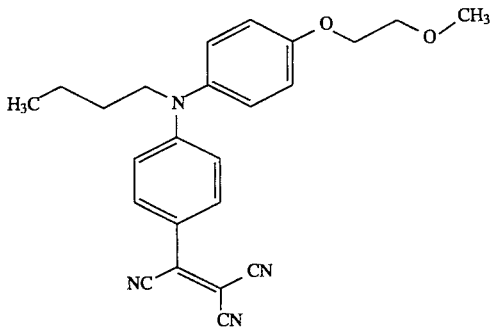

Dye II:

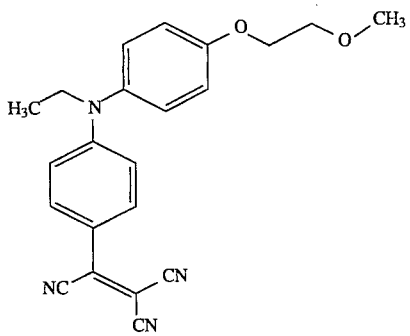

A high amount of dust and dirt was applied to the thermal head. Several cleaning solutions were prepared; a complete list of ingredients can be found in table I. The percentages in table I are weight percentages in the coating solution. The cleaning solution was introduced into a felt-tip pen (the flat tip of the pen measures 2 by 5 mm (10 $mm^2$)).

The thermal head was cleaned with the felt-tip pens prepared as described above. The drying process was evaluated visually. The cleaning effect and the spreading of the lubricant was evaluated under an optical microscope and after the cleaning procedure an image was printed with the dye-donor elements and image receiving sheets described above. The image quality of the printed image was examined visually (streakes, density, uniformity). For all evaluations described above, the following criteria are used: E=excellent; G=good; B=bad

TABLE I

| | | Solvents | | | | | | |
|---|---|---|---|---|---|---|---|---|
| Ex. | Lub* | Buta | Isoprop | Cycl. | Drying | Cleaning | Spreading | Qual. |
| 1 (comp) | 100 | — | — | — | E | B | G | B |
| 2 (comp) | — | 100 | — | — | E | E | — | B |
| 3 | 2 | 88 | 10 | — | E | E | E | E |
| 4 | 1 | 89 | 10 | — | E | E | E | G |
| 5 | 2 | 78 | — | 20 | G | E | E | G |
| 6 | 2 | — | 98 | — | G | G | E | E |
| 7 | 5 | 85 | 10 | — | G | E | E | G |
| 8** | 2 | 88 | 10 | — | E | E | E | E |

*Tegoglide 410 (Goldschmidt), a polyether modified polydimethylsiloxane (lubricant).
**The thermal head has in advance been cleaned with a wipe soaked with a cleaning solution comprising 34% isopropanol, 51% water, 5% Luviskol K90 (polyvinyl pyrrolidone, BASF) and 10% Syloid 378 (amorphous silica, Grace) and subsequently, the thermal head was wiped with a cleaning solution according to the present invention to remove the remaining inorganic powder and binder from the thermal head.
But = Butanon
Isoprop = Isopropanol
Cycl. = Cyclohexanon It can be seen from the results above that the cleaning method according to the present invention is superior to the known methods of cleaning a thermal head, since the cleaning procedure is fast and the image quality of the first print after the cleaning procedure is good or excellent.

We claim:

1. Method for cleaning a thermal head of a thermal printer, by applying a cleaning solution to the thermal head, said cleaning solution comprising at least one organic solvent having in pure state a vapour pressure above 25 mbar at 20° C. and a polysiloxane lubricant.

2. Method according to claim 1 wherein said lubricant is a liquid.

3. Method according to claim 1 wherein said lubricant is a polydialkylsiloxane based lubricant.

4. Method according to claim 3 wherein said lubricant is a polyether modified polydimethylsiloxane.

5. Method according to claim 1 wherein the cleaning solution comprises between 0.1 and 30 weight percent of said lubricant.

6. Method according to claim 1 wherein said cleaning solution further comprises less than 10 weight percent of a solvent having in a pure state a vapour pressure at 20° C. of 25 mbar or less.

7. Method according to claim 1 wherein said cleaning solution is applied by means of a wipe soaked with said cleaning solution.

8. Method according to claim 1 wherein said cleaning solution is applied to the thermal head by means of a pen soaked with said cleaning solution.

9. Method according to claim 8 wherein said pen is a felt-tip or fiber-tip pen, wherein said tip is flat or line-shaped and wherein the surface of the flat tip is at least 2 $mm^2$ or the length of the line-shaped tip is at least 2 mm.

* * * * *